US008407952B2

(12) United States Patent
Engelmeyer

(10) Patent No.: US 8,407,952 B2
(45) Date of Patent: Apr. 2, 2013

(54) SPACER TUBE FOR AN INSULATED GLAZING, AS WELL AS DEVICE AND METHOD FOR PRODUCTION OF THE SPACER TUBE, AND INSULATED GLAZING HAVING A SPACER FRAME COMPOSED OF SUCH SPACER TUBES

(75) Inventor: Joerg Engelmeyer, Wuppertal (DE)

(73) Assignee: Helmut Lingemann GmbH & Co. KG, Wuppertal (DE)

( * ) Notice: Subject to any disclaimer, the term of this patent is extended or adjusted under 35 U.S.C. 154(b) by 577 days.

(21) Appl. No.: 12/655,942

(22) Filed: Jan. 11, 2010

(65) Prior Publication Data

US 2011/0107722 A1 May 12, 2011

(30) Foreign Application Priority Data

Nov. 10, 2009 (DE) ..... 10 2009 052 572

(51) Int. Cl.
*E06B 3/00* (2006.01)
*E06B 1/04* (2006.01)

(52) U.S. Cl. ..... 52/204.5; 49/504

(58) Field of Classification Search ..... 52/204.57, 52/204.58, 204.62, 204.5; 49/501, 504
See application file for complete search history.

(56) References Cited

U.S. PATENT DOCUMENTS 5,485,709 A * 1/1996 Guillemet ..... 52/786.13
5,498,451 A * 3/1996 Lafond ..... 428/34
5,581,971 A * 12/1996 Peterson ..... 52/786.13
5,630,306 A * 5/1997 Wylie ..... 52/786.13
5,713,177 A * 2/1998 Peterson ..... 52/741.1
6,131,364 A * 10/2000 Peterson ..... 52/786.13
6,581,341 B1 * 6/2003 Baratuci et al. ..... 52/204.5
6,877,292 B2 * 4/2005 Baratuci et al. ..... 52/786.13
7,021,110 B2 * 4/2006 Rosskamp ..... 72/326
7,107,729 B2 * 9/2006 Baratuci et al. ..... 52/204.593
2005/0227025 A1 10/2005 Baratuci et al.
2010/0107529 A1 5/2010 Engelmeyer
2011/0027606 A1 * 2/2011 Lenhardt ..... 428/586

FOREIGN PATENT DOCUMENTS

DE 69 41 118 10/1969
DE 72 14 853 4/1972
DE 82 28 839 2/1983
DE 299 08 779 10/2000
EP 2 177 702 4/2010

OTHER PUBLICATIONS

European Search Report in EP 10173725.2 dated Oct. 26, 2010 with English translation of relevant parts.
German Examination Report in DE 10 2009 052 572.6 dated Sep. 9, 2010 with English translation of relevant parts.

* cited by examiner

*Primary Examiner* — Andrew Triggs
(74) *Attorney, Agent, or Firm* — Collard & Rose, P.C.

(57) ABSTRACT

The present invention relates to a spacer tube (1) for the production of spacer frames for multi-pane insulated glazing having at least two glass panes, having a tube wall (2) that has a visible wall (6), a bottom wall (7) that lies opposite the former, and two side walls (8) that lie opposite one another, for a connection with a glass pane each, whereby at least one of the two side walls (8) is cold-strengthened, at least in partial regions, to increase the bending stiffness of the spacer tube (1), as well as a multi-pane insulated glazing having a spacer frame having at least one such spacer tube (1), and a device and a method for production of the spacer tube (1).

22 Claims, 6 Drawing Sheets

Figure 1:
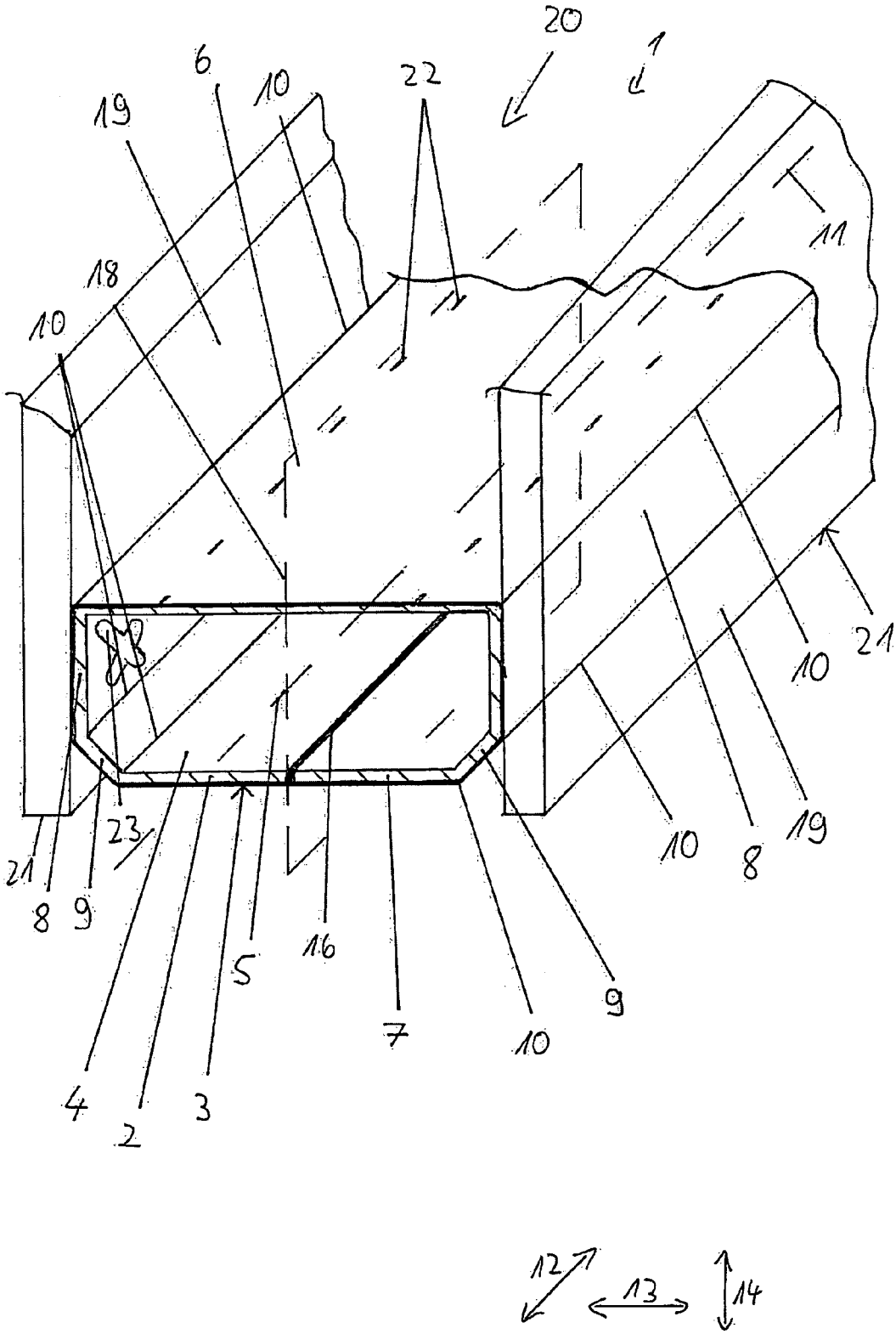

SPACER TUBE FOR AN INSULATED GLAZING, AS WELL AS DEVICE AND METHOD FOR PRODUCTION OF THE SPACER TUBE, AND INSULATED GLAZING HAVING A SPACER FRAME COMPOSED OF SUCH SPACER TUBES

CROSS REFERENCE TO RELATED APPLICATIONS

Applicants claim priority under 35 U.S.C. §119 of German Application No. 10 2009 052 572.6 filed on Nov. 10, 2009.

The present invention relates to a spacer tube for the production of a spacer frame of an insulated glazing, as well as to a method and a device for its production, and to an insulated glazing having a spacer frame composed of such spacer tubes.

Conventional insulated glazing has at least two panes of glass disposed to be parallel to one another and spaced apart from one another, between which a pane interstice having a defined width is provided. In order to permanently guarantee this predefined pane interstice, a circumferential spacer frame is provided between the two panes of glass, which frame connects the two panes of glass with one another in the region of their outer pane edges, and keeps them spaced apart. In this connection, the spacer frame consists of a thin-walled spacer tube having an essentially rectangular cross-section, which tube was bent accordingly, to form the spacer frame, or of multiple individual spacer tubes that are set onto one another by means of corner connectors.

Such spacer tubes are, for example, hollow profiles made of aluminum, which are produced from an aluminum strip by means of roll-bending or roll-forming, and subsequent welding of the abutting longitudinal edges of the aluminum strip. These spacer tubes have a wall thickness of 0.2-0.6 mm.

Furthermore, spacer tubes made of stainless steel are known. The stainless steel spacer tubes are also produced from a stainless steel strip, by means of roll-bending or roll-forming, and subsequent welding of the abutting longitudinal edges of the strip, and have a wall thickness of 0.15 to 0.2 mm.

A disadvantage of the aluminum and stainless steel spacer tubes is, for one thing, that the material costs of aluminum and stainless steel have increased tremendously, particularly in recent years. Furthermore, handling and further processing of the spacer tubes to produce spacer frames is often difficult. This is because the spacer tubes generally have a length of 5000 mm to 7000 mm before being bent to form the spacer frame. As a result of this, because of their length, spacer tubes tend to bend through, viewed over their entire tube length, about bending axes that run parallel to the tube width direction and/or the tube height direction. This length instability and lability is particularly disadvantageous when bending the spacer tubes to form the spacer frame, usually by 90°, particularly in the case of large frames.

Furthermore, there are spacer tubes made of plastic, which are produced by means of extrusion. Spacer tubes made of polymer materials having lower heat conductivity values have a lower heat transfer coefficient in comparison with spacer tubes made of stainless steel, and can be produced cost-advantageously. However, further processing, particularly bending to form the spacer frames, is difficult. Furthermore, plastic is not UV-resistant, tends to age, and is not completely diffusion-sealed. For this reason, it is known to cover the backs of the spacer tubes with a metallic foil. The foil acts as a diffusion barrier. However, the other disadvantages of spacer tubes made of plastic that were mentioned are not eliminated by this.

It is therefore the task of the present invention to make available a spacer tube for the production of spacer frames of multi-pane insulated glazing, which tube can be produced easily and cost-advantageously, and also implements good processing, i.e. good handling.

Furthermore, multi-pane insulated glazing having such a spacer tube is supposed to be created.

Another task of the invention is to make available a device and a production method for simple and cost-advantageous production of the spacer tube.

These tasks are accomplished by means of the characteristics of claims 1, 18, 19, and 23. Advantageous further developments of the invention are characterized in the subsequent dependent claims, in each instance.

Figure 5:
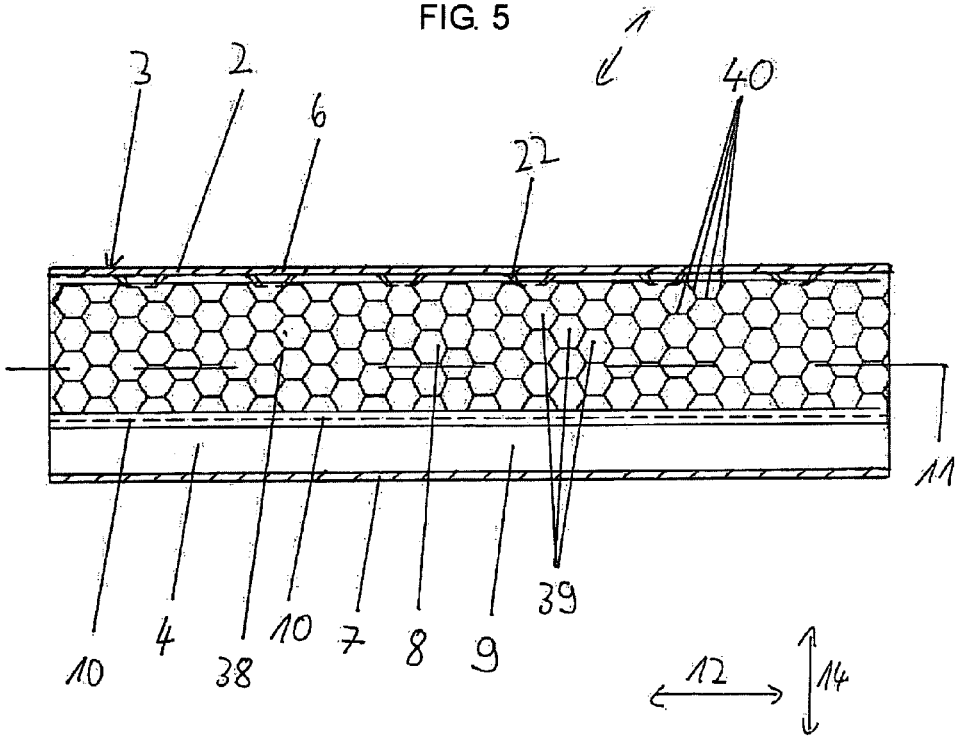
Figure 6:
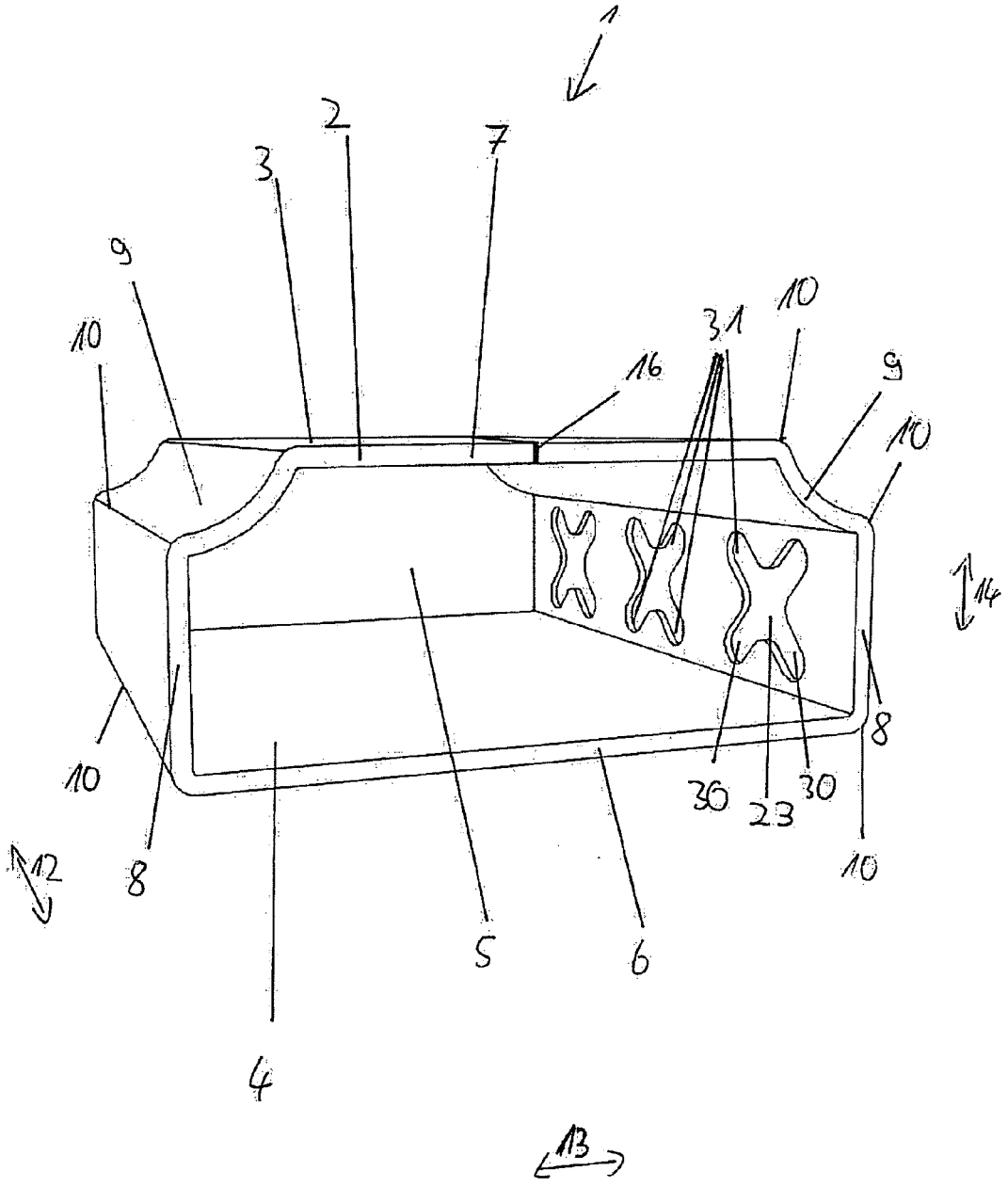

In the following, the invention will be explained in greater detail, using a drawing, as an example. This shows:

FIG. 1: A perspective cross-section view of the spacer tube according to the invention, according to a first embodiment, disposed between two glass panes of a multi-pane insulated glazing according to the invention FIG. 2: A spacer tube according to the invention, according to FIG. 1, in longitudinal section FIG. 3: A spacer tube according to the invention, according to another embodiment, in longitudinal section FIG. 4: A spacer tube according to the invention, according to another embodiment, in longitudinal section FIG. 5: A spacer tube according to the invention, according to another embodiment, in longitudinal section FIG. 6: A perspective cross-section view of the spacer tube according to the invention, according to the first embodiment, with rounded transition walls FIG. 7: A broad-side view of an embossed longitudinal metal strip FIG. 8: A broad-side view of another embossed longitudinal metal strip FIG. 9: An embossed-surface-side view of an embossing roller (half in section) and a counter-pressure roller The thin-walled spacer tube 1 according to the invention (FIG. 1-6), preferably consisting of metal, has a tube wall 2 having an outer wall surface 3 and an inner wall surface 4. In particular, the spacer tube 1 consists of steel or aluminum. The tube wall 2 encloses, i.e. surrounds a tube interior 5. Furthermore, the spacer tube 1 has an essentially rectangular cross-section, in other words is configured in the shape of a box. The tube wall 2 furthermore has a visible or ceiling wall 6, which is preferably planar or, i.e. plate-shaped, a bottom or rear wall 7 that lies opposite the former and, in practical manner, is parallel to it, preferably also planar, i.e. plate-shaped, and two side walls, i.e. pane contact walls 8 that are preferably straight, i.e. plate-shaped. The side walls 8 preferably extend perpendicular to the visible wall 6 and to the bottom wall 7. It is practical if furthermore, a transition wall 9 is provided between a side wall 8 and the bottom wall 7, in each instance. The side walls 8 and the visible wall 6 preferably make a transition into one another directly. Furthermore, the walls 6; 7; 8; 9 that border on one another are disposed at an angle from one another, in each instance, and make a transition into one another by way of a folded edge, i.e. corner edge, i.e. bent edge 10, in each instance. In this connection, the two transition walls 9 are preferably configured as a type of bevel, in other words the corner region between a side wall 8 and the bottom wall 7, in each instance, is flattened by way of the transition walls 9. It is practical if the transition walls 9 are configured to be planar, i.e. plate-shaped (FIG. 1). As an alternative to this, transition walls 9 are configured to be rounded (FIG. 6). In particular, the transition walls 9 are configured to be rounded in such a manner that the outer wall surface 3 has a concave curvature in the region of the transition walls 9, and the inner wall surface 4 has a convex curvature.

The spacer tube 1 has a central longitudinal axis 11 and a longitudinal extension in the direction of a longitudinal tube direction 12 that runs parallel to the longitudinal axis 11. Furthermore, the extension of the spacer tube 1 in a tube width direction 13 perpendicular to the longitudinal axis 11 is preferably greater than in a tube height direction 14 perpendicular to this direction and to the longitudinal axis 8. The spacer tube 1 is therefore more broad than high. In this connection, the visible wall 6 and the bottom wall 7 extend parallel to the longitudinal tube direction 12 and to the tube width direction 13, and the side walls 8 extend parallel to the longitudinal tube direction 12 and to the tube height direction 14.

It is practical if the spacer tube 1 according to the invention is produced by means of roll-deformation, from a longitudinal metal strip 15 (FIG. 7, 8), and this will be discussed in greater detail below. As a result, the spacer tube 1 has a longitudinal weld seam 16 that extends parallel to the longitudinal tube axis 11. By means of the longitudinal weld seam 16, the regions of two longitudinal edges 17 of the longitudinal metal strip 15 that border on one another after roll-bending, i.e. roll-forming are welded to one another. It is furthermore practical if the longitudinal weld seam 16 is disposed in the region of the bottom wall 7 and preferably disposed centered with regard to the extension of the bottom wall 7 in the tube width direction 13. The spacer tube 1 is therefore preferably configured symmetrical to a tube center plane 18 that contains the longitudinal axis 11 and is parallel to the tube height direction 14.

Alternatively to this, the spacer tube 1 is connected in some other manner alongside, in place of the longitudinal weld seam 16.

The spacer tube 1 serves, in known manner, for the production of spacer frames for a multi-pane insulated glazing according to the invention. An insulated glazing according to the invention has at least two glass panes 19 disposed parallel to one another and spaced apart from one another, between which a pane interstice 20 having a defined width is present. Between the two glass panes 19, a circumferential spacer frame is provided, which connects the two glass panes 19 with one another in the region of their circumferential outer pane margins, i.e. pane edges 21, and keeps them spaced apart. In this connection, the circumferential spacer frame has a spacer tube 1 according to the invention, for example, which was bent accordingly, to form the spacer frame, about bending axes that run parallel to the tube width direction 13. Alternatively to this, a spacer frame has multiple individual spacer tubes 1 that are set onto one another by means of corner connectors, and were partly bent about bending axes that run parallel to the tube width direction 13, if necessary.

In the installed state in the multi-pane insulated glazing, a spacer frame is disposed in such a manner that the two side walls 8 of the spacer tube 1, i.e. of the spacer tubes 1 are disposed adjacent and parallel to the glass panes 19. Furthermore, the two side walls 8 are connected with the glass panes 19 in moisture-tight and air-tight manner, by means of a suitable adhesive. As a result, the two glass panes are kept at a distance at their edges 21. Furthermore, the spacer frame delimits the pane interstice 20 formed between the two glass panes 19 toward the outside. Furthermore, the visible wall 6 is always disposed so as to face the pane interstice 20, and the bottom wall 7 faces away from the pane interstice 20, toward the outside. The visible wall 6 is consequently visible in the installed state. As a result, it is practical if the longitudinal weld seam 16 is not disposed in the region of the visible wall 6, in order not to be visible in the installed state of the spacer tube 1.

Furthermore, multiple known passage recesses, i.e. perforation openings 22, preferably in the form of slits that pass through the visible wall 6, are preferably introduced, particularly punched, into the visible wall 6, whereby the perforation openings 22 create a fluidic connection between the tube interior 5 and the pane interstice. The visible wall 6 therefore serves as a gas exchange wall. The perforation openings 22 can also be structured, at least in part, as oblong holes that extend parallel to the tube width direction 13 (not shown).

Figure 2:
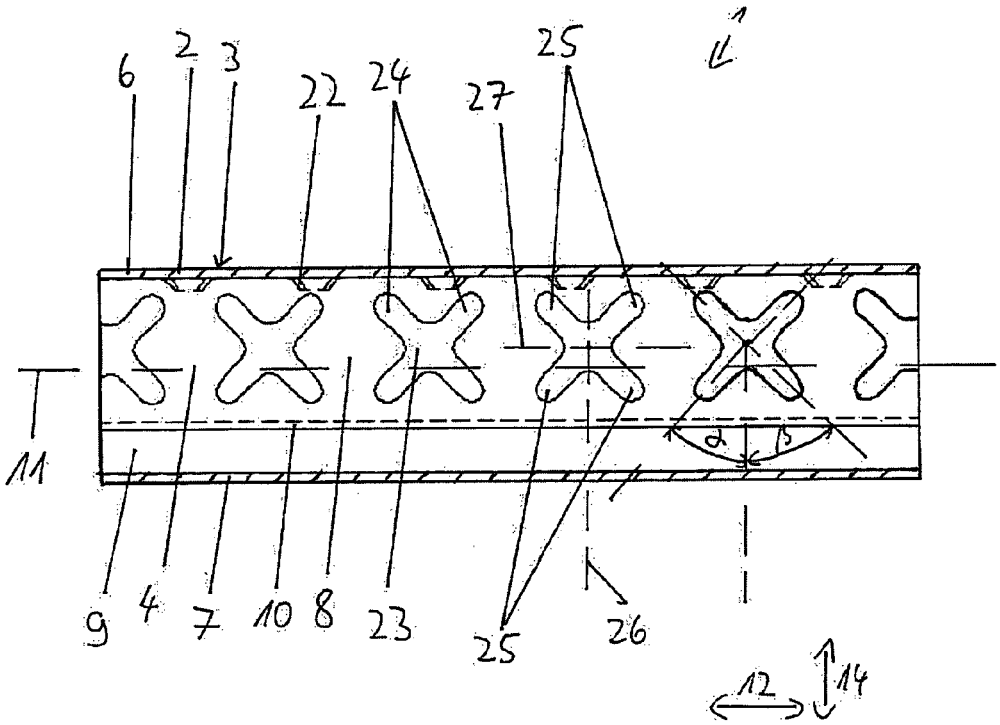
Figure 3:
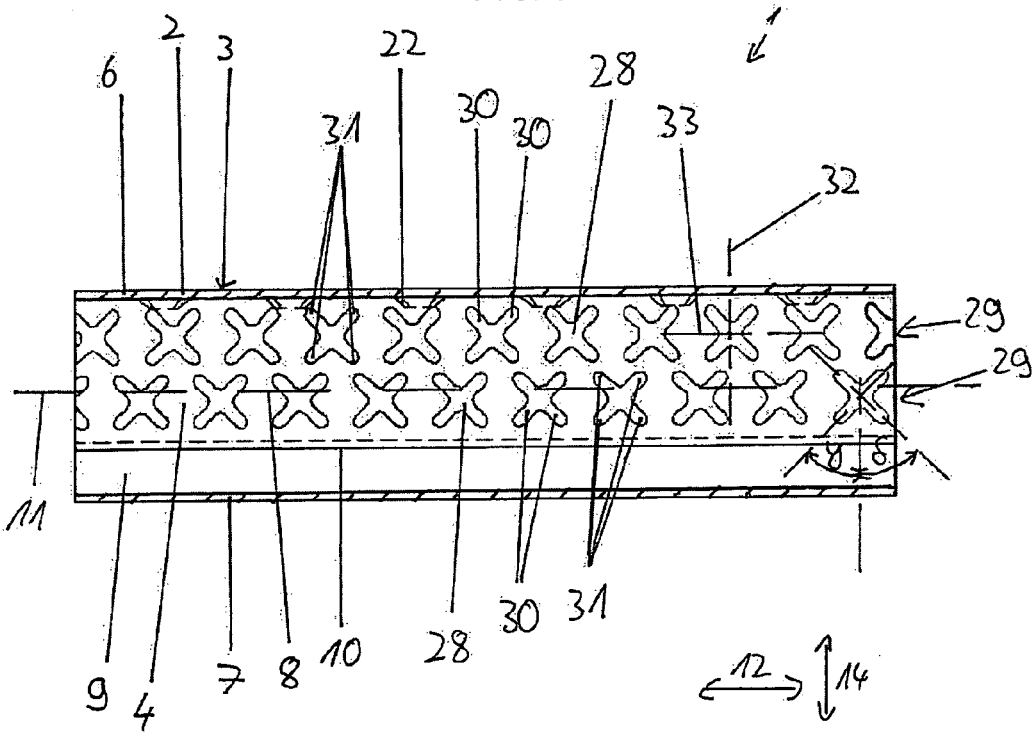
Figure 4:
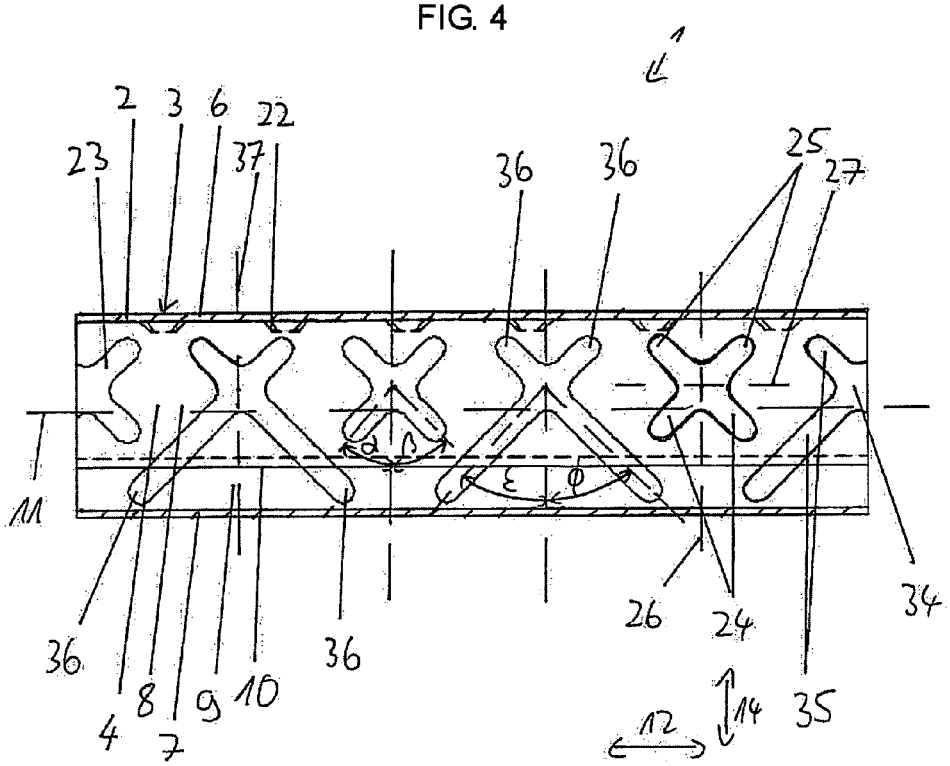

According to the invention, at least one of the two side walls 8 has an embossing. The embossing can have multiple individual embossed elements 23; 28; 34, for example, which are disposed distributed over the entire side wall 8 two-dimensionally, particularly in uniform manner, in each instance (FIG. 2-4). Or this can be a closed, area-wide embossing pattern (FIG. 5).

Preferably, in this connection, the embossings are introduced into the two side walls 8 from the side of the inner wall surface 4. As a result, the embossings are configured as depressions in the side wall 8, in each instance, viewed from the inner wall surface 4 (FIG. 6). Preferably, the embossings do not extend through the entire side wall 8, but rather only into it by 10% to 50%, preferably 20% to 30% of the wall thickness, for example, so that the outer wall surface 3 is preferably smooth, i.e. even-surfaced in the region of the side walls 8 (FIG. 1). If the embossings extend through the entire side wall 8, the outer wall surface 3 is preferably even-surfaced in the non-embossed wall sections.

According to a first preferred embodiment (FIG. 2, 1, 6), the embossings have individual embossed elements in the form of first embossing crosses, i.e. X-shaped embossed elements 23, which are disposed spaced apart from one another and adjacent to one another, viewed in the longitudinal tube direction 12. In particular, only one first X-shaped embossed element 23 is present, viewed in the tube height direction 14, which element is preferably disposed centered with regard to the extension of the side wall 8, in each instance, viewed in the tube height direction 14. In particular, the extension of a first X-shaped embossed element 23 in the tube height direction 14 amounts to at least 10%, preferably 20% to 70%, especially 40% to 60% of the total extension of the side wall 8, in each instance, in the tube height direction 14. The extension of the first X-shaped embossed element 23 in the tube height direction 14 preferably amounts to from 0.6 to 6 mm, especially 2.5 mm to 5.5 mm. The distance of the individual first X-shaped embossed elements 23 from one another in the longitudinal tube direction 12 preferably amounts to 2 mm to 10 mm, especially 4 mm to 5 mm.

The first X-shaped embossed elements 23 have two shanks 24, in each instance, which intersect in the center, with regard to their longitudinal extension. It is practical if the two shanks 24 are furthermore disposed at right angles relative to one another and preferably have the same length. The two shanks 24 have shank ends 25 that lie opposite one another, in each instance, and are preferably rounded off. Furthermore, it is practical if the first X-shaped embossed elements 23 are configured symmetrical to a plane 26 that is perpendicular to the longitudinal tube direction 12 and/or to a plane 27 that is perpendicular to the tube height direction 14. And the two shanks 24 preferably enclose an angle $\alpha$, $\beta \neq 0$, preferably $\alpha$, $\beta = 45°$, with the tube height direction 14, in each instance.

According to another preferred embodiment (FIG. 3), the embossings have embossed elements in the form of second X-shaped embossed elements 28 that are disposed in at least two rows 29 disposed one above the other, viewed in the tube height direction 14, whereby one row 29 has multiple second X-shaped embossed elements 28 disposed spaced apart from one another, and adjacent to one another, in the longitudinal tube direction 12, respectively. In particular, the extension of a second X-shaped embossed element 28 in the tube height direction 14 amounts to at least 15%, preferably 30% to 50%, preferably 35% to 45% of the total extension of the side wall 8, in each instance, in the tube height direction 14.

The second X-shaped embossed elements 28 are configured analogous to the first X-shaped embossed elements 23, except for their size, and also have two shanks 30 in each instance that intersect in the center with regard to their longitudinal extension. It is practical if the two shanks 30 of the second X-shaped embossed elements 28 are also disposed at right angles relative to one another and preferably have the same length. The two shanks 30 of the second X-shaped embossed elements 28 have two shank ends 31 that lie opposite one another, in each instance, and are rounded off. Furthermore, it is practical if the second X-shaped embossed elements 28 are configured symmetrical to a plane 32 that lies perpendicular to the longitudinal tube direction 12 and/or to a plane 33 that lies perpendicular to the tube height direction 14. And the two shanks 30 preferably enclose an angle $\gamma$, $\delta \neq 0$, preferably $\gamma$, $\delta = 45°$, with the tube height direction 14, in each instance. Furthermore, the second X-shaped embossed elements 28 of the one row 29 are preferably offset relative to the second X-shaped embossed elements 28 of the other row 29, viewed in the longitudinal tube direction 12.

According to another preferred embodiment (FIG. 4), a side wall 8 has two different types of X-shaped embossed elements 23; 34, which are disposed spaced apart from one another, and adjacent to one another, viewed in the longitudinal tube direction 12, respectively, whereby the two different X-shaped embossed elements 23; 34 are preferably disposed alternately, viewed in the longitudinal tube direction 12. In this connection, the two different types of X-shaped embossed elements 23; 34 are first and third X-shaped embossed elements 23; 34. With regard to the placement, configuration, etc. of the first X-shaped embossed elements 23, reference is made to the explanations presented above.

The third X-shaped embossed elements 34 also have two shanks 35, which preferably intersect at the same level as the shanks 24 of the first X-shaped embossed elements 23. It is practical if the two shanks 35 of the third X-shaped embossed elements 34 are furthermore also disposed at right angles relative to one another and preferably have the same length. The two shanks 35 of the third X-shaped embossed elements 34 also have two shank ends 36 that lie opposite one another, in each instance, and are preferably rounded off.

In comparison with the shanks 24 of the first X-shaped embossed elements 23, however, each of the two shanks 35 of the third X-shaped embossed elements 34 is configured to be extended in the direction of the transition wall 9, in each instance, and extends around the folded edge 10 into the transition wall 9. In the direction of the visible wall 6, the shanks 35 of the third X-shaped embossed elements 34 are not extended, and are thus configured analogous to the shanks 24 of the first X-shaped embossed elements 23. As a result, it is practical if the third X-shaped embossed elements 34 are configured to be symmetrical only to a plane 37 that lies perpendicular to the longitudinal tube direction 12. Furthermore, the two shanks 35 preferably also enclose an angle $\epsilon$, $\phi \neq 0$, preferably $\epsilon$, $\phi = 45°$, with the tube height direction 14, in each instance. In particular, the first and third X-shaped embossed elements 23; 34 are configured and disposed in identical manner, with the exception of the length of their shanks 24; 35.

According to another preferred embodiment (FIG. 5), the embossings are a honeycomb embossing, in each instance, in other words a honeycomb pattern 38 embossed into the side wall 8, in each instance. The honeycomb pattern 38 is configured area-wide, in other words covers the side wall 8, in each instance, particularly the inner wall surface 4 in the region of the side wall 8, completely, i.e. over its full area, particularly in the manner of a parquet covering. As a result, the honeycomb pattern 38 is a closed pattern. The honeycomb pattern 38 has multiple, individual honeycomb cells 39 having a regular hexagonal layout, which border on one another and are surrounded, i.e. delimited by six crosspieces 40, in each instance. The crosspieces 40 separate the individual honeycomb cells 39 from one another and are embossed into the side wall 8, in each instance, for this purpose. A crosspiece 40 preferably has a length of 0.3 mm to 1 mm, preferably 0.5 mm to 0.7 mm, in each instance.

In the following, the production of the spacer tube 1 according to the invention, by means of the device according to the invention, will now be explained in greater detail.

As has already been explained above, production of the spacer tube 1 takes place by means of roll-bending, i.e. roll-forming, and longitudinal welding. For this purpose, first a relatively broad metal strip, particularly a stainless steel strip or an aluminum strip, is cut into multiple longitudinal metal strips 15, particularly longitudinal stainless steel strips or longitudinal aluminum strips, which strips are parallel to one another, in a metal strip cutting device, and these strips are preferably wound onto a reel. Alternatively to this, the longitudinal metal strips 15 are already present wound onto a reel. The longitudinal metal strip 15 has the two lateral longitudinal strip edges 17 as well as two planar strip broad sides 41 that lie opposite one another. Furthermore, the longitudinal metal strip 15 has a longitudinal strip direction 42 that is parallel to a horizontal conveying direction 43, and a transverse strip direction 44 that is horizontal and perpendicular to the longitudinal strip direction 42.

Subsequently, the longitudinal metal strip 15 is continuously drawn off the reel and passed, in a conveying direction 43, to an embossing device of the device according to the invention, by means of which the embossings of the two side walls 8 and, if applicable, of the two transition walls 9 are introduced into the longitudinal metal strip 15. In this connection, the longitudinal metal strip 15 is preferably oriented horizontally with its two strip broad sides 41, so that one of the two strip broad sides 41 is disposed above the other strip broad side 41. Furthermore, the one of the two strip broad sides 41 forms the outer wall surface 3 in the finished spacer tube 1, and the other strip broad side 41 forms the inner wall surface 4.

Figure 9:
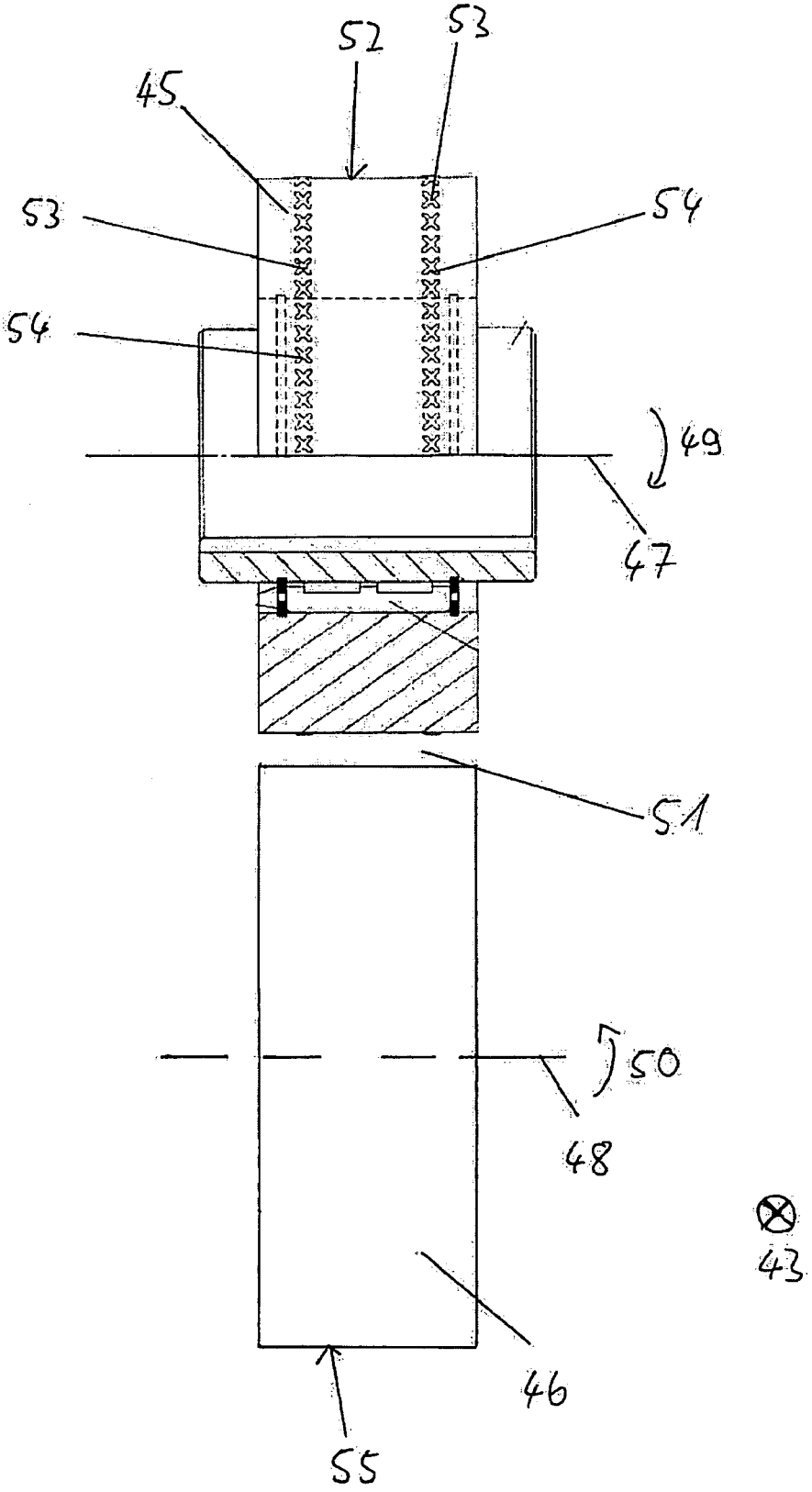

For introducing the embossings, the embossing device has an embossing roller 45 and a counter-pressure roller 46, which are disposed one above the other, in the vertical direction, and spaced apart from one another (FIG. 9). The embossing roller 45 and the counter-pressure roller 46 are mounted to rotate about an axis of rotation 47; 48, in each instance, that lies horizontally and perpendicular to the conveying direction 43, whereby the two axes of rotation 47; 48 are disposed to align vertically with one another. The embossing roller 45 and the counter-pressure roller 46 can be driven in opposite directions of rotation 49; 50. An embossing nip 51 is formed between the embossing roller 45 and the counter-pressure roller 46, through which nip the longitudinal metal strip 15 is passed for embossing.

To introduce the embossings into the longitudinal metal strip 15, the embossing roller 45 has an exterior, circumferential embossing surface 52 that is essentially cylindrical, and has positive, i.e. convex, i.e. projecting embossing dies, i.e. embossing stamp elements 53, in each instance. The embossing dies 53 are configured in such a manner and disposed on the embossing surface 52 in such a manner that when the longitudinal metal strip 15 is passed through the embossing nip 51, the desired embossings are introduced into the longitudinal metal strip 15. For introducing the first X-shaped embossed elements 23, the embossing surface 52 has embossing die rows 54, for example, which are disposed at a distance from one another, and adjacent to one another, in a direction parallel to the axis of rotation 47, respectively. A region without any kind of embossing dies 53 is situated between the two embossing die rows 54. The counter-pressure roller 46, on the other hand, preferably has a smooth circumferential surface 55.

As has already been explained, the longitudinal metal strip 15 is passed through the embossing nip 51 in the conveying direction 43, and continuously embossed as this happens, when the embossing roller 45 rolls on the longitudinal metal strip 15 in the conveying direction 43. In this connection, the longitudinal metal strip 15 is passed through the embossing nip 51 with the first strip broad side 41 facing the embossing surface 52 and with the second strip broad side 41 facing the circumference surface 55. Because of the smooth circumference surface 55, the embossings are pressed into the longitudinal metal strip 15 from the first strip broad side 41, in this connection, but it is practical if they do not go through all the way to the second strip broad side 41. As a result, the second strip broad side 41 remains smooth, i.e. even-surfaced, and forms the outer wall side 3 in the subsequent spacer tube 1. The first strip broad side 41 consequently forms the inner wall side 4.

Figure 7:
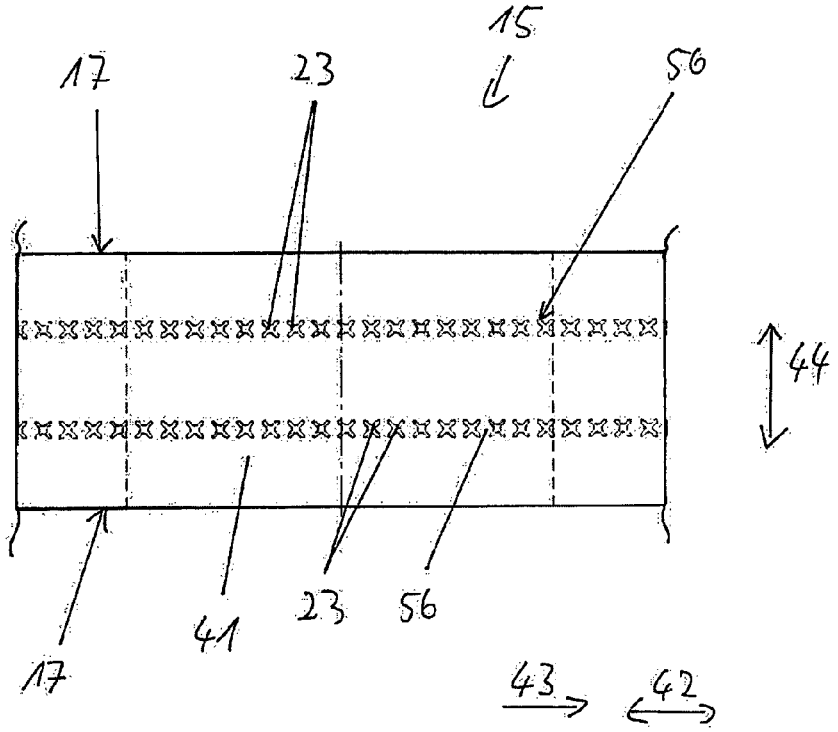
Figure 8:
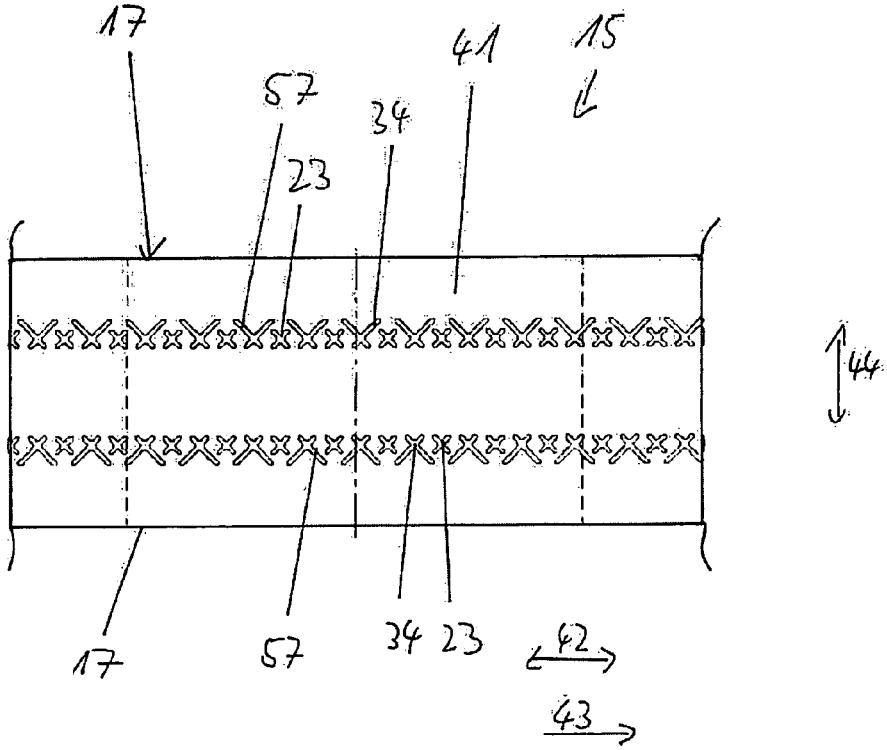

If the embossings described above, having the first X-shaped embossed elements 23, are supposed to be produced, the first X-shaped embossed elements 23 are introduced into the longitudinal metal strip 15 in the form of two rows 56 spaced apart from one another in the transverse strip direction 44 (FIG. 7). The individual first X-shaped embossed elements 23 of a row 56 are disposed spaced apart from one another, and adjacent to one another, viewed in the longitudinal strip direction 42, respectively. The two rows 56 are furthermore disposed in such a manner that they are disposed in the region of the two side walls 8 after bending of the longitudinal metal strip 15 to produce the spacer tube 1.

In the case of the embossing having the first and third X-shaped embossed elements 23; 34, two rows 57 spaced apart from one another in the transverse strip direction 44 are introduced into the longitudinal metal strip 15, whereby one row 57 consists of first and third X-shaped embossed elements 23; 34, which are disposed spaced apart from one another, and adjacent to one another, as well as alternating, viewed in the longitudinal strip direction 42, respectively. In this connection, the two rows 57 are disposed in such a manner that they are disposed in the region of the two side walls 8 after bending of the longitudinal metal strip 15 to form the spacer tube 1, and the extended shanks 35 of the third X-shaped embossed elements 34 are disposed in the region of the transition walls 9.

After introduction of the embossings, it is practical if the perforation openings 22 are introduced into the longitudinal metal strip 15, in known manner, using a punching device. For this purpose, the longitudinal metal strip 15 is passed, in the conveying direction 43, between two punching rollers that are driven in opposite directions of rotation about a horizontal axis, in each instance, and are disposed spaced apart from one another vertically. The punching rollers have corresponding punching means for introducing the perforation openings 22. In particular, the one punching roller has teeth that project from its mantle surface, and the other punching roller has recesses that correspond to them. The perforation openings 22 are introduced into the region that forms the visible wall 6 of the subsequent spacer tube 1.

After the perforation openings 22 have been introduced, the embossed and perforated metal strip 15 is continuously deformed, in a roll-bending device, i.e. roll-deformation device of the device according to the invention, by means of roll-deformation, into a longitudinally slit endless spacer tube, in such a manner that its cross-section shape already essentially corresponds to the cross-section shape of the finished spacer tube 1. In particular, the longitudinal metal strip 15 is bent in such a manner that the two longitudinal edges 17 abut one another. In particular, the longitudinal metal strip 15 is folded, i.e. bent in such a manner that the folded edges 10 are formed. In other words, the longitudinal metal strip 15 is bent about axes that are parallel to the conveying direction 43 and to the longitudinal strip direction 42, i.e. to the subsequent longitudinal axis 11. Furthermore, the longitudinal metal strip 15 is deformed in such a manner that the embossed first strip broad side 41 is disposed on the inside and forms the inner wall surface 4. Furthermore, the longitudinal metal strip 15 is deformed in such a manner that the two longitudinal edges 17 are disposed centered in the bottom wall 7.

Roll-deformation takes place in known manner, with corresponding roll-forming tools, particularly with multiple pairs of deformation rollers (not shown), which are disposed one behind the other in the conveying direction 43. In this connection, the longitudinal metal strip 15 is passed through between the two deformation rollers of a pair of deformation rollers, in each instance. In this connection, the one deformation roller has a circumference surface having a concave curvature, and the other deformation roller has a circumference surface having a convex curvature, whereby the circumference surfaces are coordinated with one another in such a manner, and the curvature increases from one pair of rollers to the next in such a manner that little by little, the longitudinal metal strip 15 is bent to form the longitudinally slit endless spacer tube.

In a welding device of the device according to the invention that follows the roll-deformation device, the two longitudinal edges 17 that abut one another are welded to one another, particularly continuously, by means of producing the longitudinal weld seam 16. Welding takes place by means of heating the tube wall 2 in the region of the two longitudinal edges 17 and pressing the two longitudinal edges 17 against one another, for example by means of pressure rollers that press onto the side walls 8 from the outside, for example. Welding preferably takes place by means of laser welding or induction welding.

Alternatively to this, the longitudinal edges 17 are welded to one another in some other way, for example by means of a crimped seam. Furthermore, it also lies within the scope of the invention to connect the longitudinal edges 17 with one another in a connection device, in a manner other than by means of welding.

The welding device is followed by a known calibration device of the device according to the invention, in which the welded endless spacer tube is calibrated to its final cross-section shape. For this purpose, it is practical if the calibration device has multiple calibration rollers, in known manner.

Furthermore, the device according to the invention also has a device for cutting the endless spacer tube into individual spacer tubes 1 having a predetermined length, which follows the calibration device. The cutting device is, for example, a flying saw, in other words a saw that moves along with the endless spacer tube while cutting, in the conveying direction 43.

An advantage of the spacer tube 1 according to the invention is that it demonstrates excellent longitudinal stability even at low wall thickness values. This is because of the cold deformation by means of embossing, cold strengthening of the two side walls 8 in partial regions takes place, thereby clearly reducing the tendency toward bending over the tube length, i.e. increasing the deformation resistance against bending over the tube length, in comparison with an identical spacer tube without the embossings. The spacer tubes 1 according to the invention therefore have a greater bending stiffness, in other words the resistance to bending in the longitudinal tube direction 12, therefore particularly to bending about bending axes parallel to the tube width direction 13, is increased. Furthermore, the torsion stiffness is also increased.

As a result, the spacer tube 1 according to the invention can be handled and processed further in excellent manner. In this connection, the spacer tube 1 according to the invention preferably has a length of 5000 to 7000 mm, preferably 5000 to 6000 mm.

In this connection, it was discovered, within the scope of the invention, that it is possible to clearly reduce the wall thickness of the spacer tube 1. In particular, the tube wall 2 has a wall thickness of 0.2 to 0.4 mm, preferably 0.25 to 0.35 mm, in non-embossed wall sections. Nevertheless, the spacer tube 1 still has excellent longitudinal stability and bending stiffness even at these low wall thickness values, because the side walls 8 are cold-strengthened, at least in certain regions. Significant material costs are saved by means of the reduction of the wall thickness.

As has already been explained above, different embossings can be provided, in this connection, which bring about cold strengthening of the side walls 8 in partial regions, and thus an increase in the bending stiffness of the spacer tube 1. In particular, cup-shaped embossed elements, so-called "dimples," can also be present as embossed elements. It is practical if the dimples are disposed distributed over the entire side wall 8 two-dimensionally in each instance. Alternatively to this, each side wall 8 can have only one embossed element, for example a longitudinal bead, that extends in the longitudinal tube direction 12. In this case, the embossed element extends over the entire tube length of the spacer tube 1. Also, multiple longitudinal beads can be provided. Furthermore, the embossed elements can also be pattern-like elements that cover only a part of the side wall 8, in each instance.

Furthermore, it does, of course, lie within the scope of the invention that the embossings are introduced into the tube wall 2 from the outer wall surface 3. Furthermore, the embossings can go through from the inner wall surface 4 to the outer wall surface 3, or vice versa, so that the embossings are visible both from the outer wall surface 3 and from the inner wall surface 4. In this case, a second embossing roller that has an embossing surface with concave embossing dies is present in place of the counter-pressure roller. However, it is preferred that the outer wall surface 3 is configured to be smooth, since this guarantees precise contact of the side walls 8 with the glass panes 19. Furthermore, in this case, the tube wall 2 is clearly embossed to become thinner, in other words the wall thickness in the embossed wall sections is reduced and is therefore lower than in the non-embossed wall sections, and this brings about particularly good cold strengthening.

Furthermore, it lies within the scope of the invention to provide embossings also in the bottom wall 7, in order to further increase stability. Only the visible wall 6 should not be embossed, since it is visible through the glass panes 19 in the installed state.

The production method as a whole or the individual method steps can take place continuously, in other words in a single production line, or also not continuously, in individual devices separated from one another. In the continuous method, the individual devices are disposed one following the other, in accordance with the method sequence.

The invention claimed is:

1. Spacer tube for the production of a spacer frame for multi-pane insulated glazing having at least two glass panes, having a tube wall, the tube wall having a visible wall, a bottom wall that lies opposite the visible wall, and two side walls that lie opposite one another, for connecting with a glass pane, in each instance, wherein at least one of the two side walls has an embossing that cold-strengthens the respective side wall in order to increase the bending stiffness of the spacer tube, wherein the embossing is configured as a depression, viewed from an inner wall surface or from an outer wall surface of the tube wall, and wherein the embossing does not extend through the entire side wall, so that a wall thickness in embossed wall sections of the side wall is lower than in non-embossed wall sections of the side wall.

2. Spacer tube according to claim 1, wherein the embossing has multiple individual embossed elements that are distributed over the entire side wall, in each instance.

3. Spacer tube according to claim 2, wherein the individual embossed elements are in the form of first X-shaped embossed elements that are disposed spaced apart from one another, and adjacent to one another, viewed in a longitudinal tube direction, respectively, whereby the first X-shaped embossed elements are disposed in one row.

4. Spacer tube according to claim 2, wherein the embossed elements are in the form of second X-shaped embossed elements that are disposed in multiple rows, wherein the rows are spaced one above the other, viewed in the tube height direction, whereby a row) has multiple second X-shaped embossed elements that are disposed spaced apart from one another, and adjacent to one another, viewed in a longitudinal tube direction, respectively.

5. Spacer tube according to claim 2, wherein the second X-shaped embossed elements of the one row are disposed offset, in the longitudinal tube direction, relative to the second X-shaped embossed elements of the row, which is adjacent in the tube height direction to the one row.

6. Spacer tube according to claim 2, wherein a side wall has first and third X-shaped embossed elements that are disposed spaced apart from one another, and adjacent to one another, viewed in the longitudinal tube direction, respectively, whereby the first and third X-shaped embossed elements are disposed alternately, viewed in the longitudinal tube direction.

7. Spacer tube according to claim 6, wherein the third X-shaped embossed elements have two intersecting shanks, in each instance, that have two shank ends, in each instance, whereby the two shanks of the third X-shaped embossed elements are configured to be extended in the direction of the transition wall, in each instance, and extend around the folded edge into the transition wall.

8. Spacer tube according to claim 1, wherein the embossing has a surface-covering pattern that preferably covers the entire side wall, in each instance.

9. Spacer tube according to claim 8, wherein the embossing pattern is a honeycomb pattern embossed into the side wall, in each instance.

10. Spacer tube according to claim 9, wherein the honeycomb pattern has multiple, individual honeycomb cells having a regular, hexagonal layout, which border on one another and are delimited by six crosspieces, in each instance.

11. Spacer tube according to claim 10, wherein the crosspieces are embossed into the side wall, in each instance.

12. Spacer tube according to claim 10, wherein the outer wall surface is even-surfaced in the region of the side walls.

13. Spacer tube according to claim 1, wherein the spacer tube is produced via roll-deformation, from a longitudinal metal strip, and is connected alongside, in the region of two longitudinal edges, particularly welded via a longitudinal weld seam.

14. Spacer tube according to claim 1, wherein the tube wall has a wall thickness of 0.2 to 0.4 mm in the non-embossed wall sections.

15. Spacer tube according to claim 1, wherein the spacer tube has a first transition wall between a first side wall of the at least two side walls and the bottom wall and has a second transition wall between a second side wall of the at least two side walls and the bottom wall, and wherein the first and second transition walls also have an embossing, at least in certain sections.

16. Spacer tube according to claim 1, wherein the embossing extends into the side wall by 10% to 50% of the wall thickness.

17. Spacer tube according to claim 16, wherein the embossing extends into the side wall by 20% to 30% of the wall thickness.

18. Spacer tube according to claim 1, wherein the embossing comprises one or more elongated beads extending in a longitudinal tube direction.

19. Multi-pane insulated glazing, having at least two glass panes disposed spaced apart from one another and adjacent to one another, between which a pane interstice is formed, whereby a spacer frame is disposed between always two glass panes, wherein the spacer frame has at least one spacer tube according to claim 1.

20. Method for production, particularly continuous production, of a spacer tube according to claim 1, having the following method steps:

a) Making available a longitudinal metal strip having two lateral longitudinal strip edges and two strip broad sides that lie opposite one another, b) Introducing embossings into the longitudinal metal strip, c) Roll-deforming the longitudinal metal strip into a longitudinally slit endless spacer tube, in which the regions that have the longitudinal edges lie against one another, d) Connecting the two longitudinal edges with one another, particularly producing a longitudinal weld seam via welding the two longitudinal edges to one another, e) In practical manner, calibrating the endless spacer tube to its final cross-section, and f) Cutting the endless spacer tube into spacer tubes having a defined length.

21. Method according to claim 20, wherein the embossings are pressed into the longitudinal metal strip from a first strip broad side, in such a manner that they do not go through all the way to the second strip broad side, so that the second strip broad side remains even-surfaced.

22. Method according to claim 21, wherein the longitudinal metal strip is roll-formed in such a manner that the first strip broad side forms the inner wall surface and the second strip broad side forms the outer wall surface.

* * * * *

UNITED STATES PATENT AND TRADEMARK OFFICE

CERTIFICATE OF CORRECTION

PATENT NO. : 8,407,952 B2
APPLICATION NO. : 12/655942
DATED : April 2, 2013
INVENTOR(S) : Engelmeyer It is certified that error appears in the above-identified patent and that said Letters Patent is hereby corrected as shown below:

In the Claims

Column 10, line 42 (line 5 of Claim 4) change “row)” to correctly read: “row”.

Column 10, line 46 (line 1 of Claim 5) change “claim 2” to read: “claim 4”.

Column 10, line 66 (line 2 of Claim 8) delete: “preferably”.

Column 11, line 10 (line 1 of Claim 12) change “claim 10” to read: “claim 1”.

Signed and Sealed this
Seventeenth Day of December, 2013

Margaret A. Focarino

Margaret A. Focarino
*Commissioner for Patents of the United States Patent and Trademark Office*